US009661438B1

(12) United States Patent
Yang et al.

(10) Patent No.: US 9,661,438 B1
(45) Date of Patent: May 23, 2017

(54) LOW LATENCY LIMITER

(71) Applicant: Amazon Technologies, Inc., Seattle, WA (US)

(72) Inventors: Jun Yang, San Jose, CA (US); Philip Ryan Hilmes, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/669,559

(22) Filed: Mar. 26, 2015

(51) Int. Cl.
*H04S 7/00* (2006.01)

(52) U.S. Cl.
CPC ..... *H04S 7/30* (2013.01)

(58) Field of Classification Search
CPC ..... H04S 7/30
See application file for complete search history.

(56) References Cited

U.S. PATENT DOCUMENTS 6,760,452 B2 * 7/2004 Lau ..... H03G 7/002 333/14
8,494,182 B2 * 7/2013 Spielbauer ..... H03G 3/001 330/278
8,682,013 B2 * 3/2014 Kjeldsen ..... H04R 25/505 381/314
8,831,249 B1 * 9/2014 Skoglund ..... H03G 7/007 381/104
8,965,774 B2 * 2/2015 Eppolito ..... H03G 7/007 381/106
2004/0213420 A1 * 10/2004 Gundry ..... H03G 7/004 381/104
2005/0281418 A1 * 12/2005 Shashoua ..... H03G 9/005 381/119
2006/0148435 A1 * 7/2006 Romesburg ..... H03F 3/68 455/199.1
2008/0025530 A1 * 1/2008 Romesburg ..... H03F 3/68 381/107
2014/0126730 A1 * 5/2014 Crawley ..... H04R 29/001 381/59
2015/0215704 A1 * 7/2015 Magrath ..... H04R 9/022 381/55

OTHER PUBLICATIONS

Hamalainen. Smoothing of the Control Signal Without Clipped Output in Digital Peak Limiters. International Conference on Digital Audio Effects (DAFx), pp. 195-198, 2002.

* cited by examiner

*Primary Examiner* — Brenda Bernardi
(74) *Attorney, Agent, or Firm* — Pierce Atwood LLP

(57) ABSTRACT

A limiter for an audio system prevents loud audio signals that exceed a threshold from being output. Output of the audio signals are delayed. When a loud signal exceeds the threshold, the gain applied to the delayed signals is gradually reduced so that by the time the loud signal reaches the output, the gain is at a level that reduces the loud audio signal to be within the threshold. Thereafter the gain is gradually restored to normal over a longer period of time than the audio signals are delayed.

20 Claims, 8 Drawing Sheets

LOW LATENCY LIMITER

BACKGROUND

In audio rendering and reproduction systems, differences in audio source material may result in large amplitude/volume level changes, such as different recordings having different dynamic ranges, or differences in levels within a song itself, and differences in levels between different content providers (e.g., one radio station to another).

BRIEF DESCRIPTION OF DRAWINGS

For a more complete understanding of the present disclosure, reference is now made to the following description taken in conjunction with the accompanying drawings.

DETAILED DESCRIPTION

Figure 1:
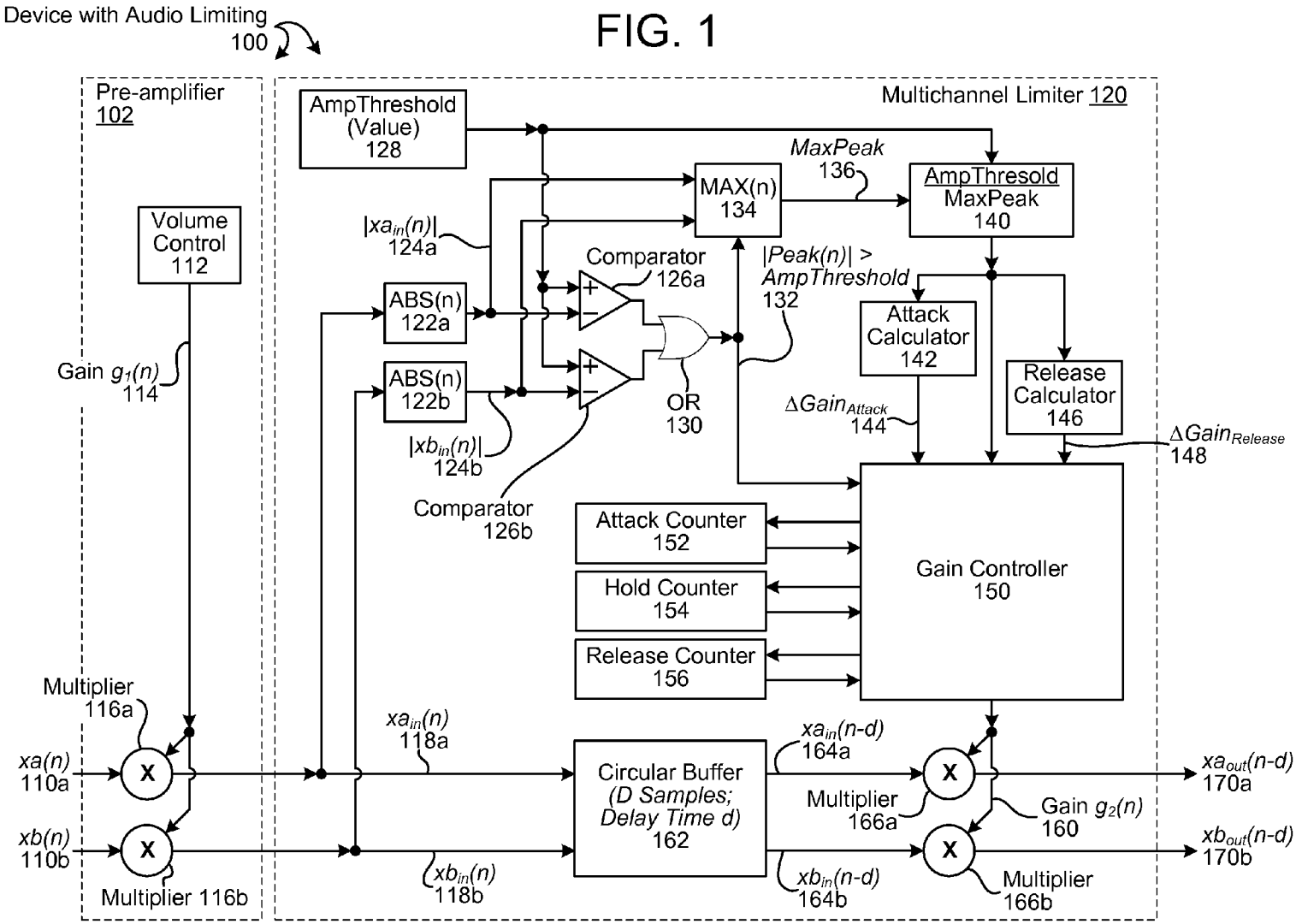
FIG. 1 is a block diagram conceptually illustrating a two-channel example of an audio limiting device.

Audio limiters are circuits and/or signal processors used in audio systems to prevent amplitude peaks in an input audio signal from exceeding positive and negative maximum amplitude "limits," attenuating the signal so that the peaks stays within the limits. Input signals with peaks within the limits may pass through the limiter without attenuation. One reason a limiter may be used is to prevent the audio signal from damaging subsequent circuitry or components in a system. For example, without a limiter, peaks exceeding the limits might "saturate" a downstream amplifier by being too large, creating distortion and potentially damaging the amplifier, speakers, etc.

Limiters can be divided into limiters that perform "hard" limiting and limiters that perform "soft" limiting. Hard limiting is sometimes referred to as "clipping." A hard limiter shears off peaks in the audio signal that are outside of the limits, squaring-off the sheared off portion of the signal waveform, replacing waveform peaks outside the limits with a "flat" steady-state maximum amplitude at or below the limit. Clipping in an audio signal that is amplified and output by speakers may be perceived as a generalized harmonic distortion and/or as loud "pops."

In comparison, a soft limiter dynamically adjusts an attenuation applied to the input audio signal so that peaks are (in an ideal system) reduced to be within the confines of the limits. A soft limiter is a form of "dynamic range compression." Dynamic range compression reduces the volume of loud sounds by narrowing or "compressing" an audio signal's dynamic range. Soft limiters engage in "downward" compression, reducing the volume of loud sounds that have peaks outside of the limits.

Downward compression can be thought of as "squeezing" an amplitude of a wave so that it will fit within the maximum positive and negative limits. While the attenuation is held constant, the original shape of the wave is retained. However, as a soft limiter ramps up or ramps down attenuation, the shape of the wave is subtly altered, with the distortion introducing harmonic components into the waveform: the faster the attenuation ramps up (referred to as the "attack") and ramps down (referred to as the "release"), the greater the distortion. Even so, a soft limiter typically creates significantly less harmonic distortion in the output waveform than is produced by the clipping of a hard limiter.

Limiters types can be further divided into limiters that adjust the instantaneous audio signal without delaying the audio signal and "look-ahead" limiters that delay the audio signal so that peak levels in the audio signal can be analyzed and an attenuation level can be dynamically set prior to the audio signal being output. Hard limiters typically operate on the instantaneous signal. Soft limiters may use either approach, but benefit from the time delay afforded by the look-ahead approach, as the delay allows attenuation to be more gradually adjusted, reducing signal distortion.

There may be multiple delays in the signal processing chain of an audio system in addition to the delay introduced by a look-ahead limiter. Since delays are cumulative, it is desirable to keep the delay of a look-ahead limiter as small as possible. An overall system delay is typically on the order of milliseconds, with an object being to have an overall delay that is imperceptible (or at least acceptable) to listeners.

With conventional designs, setting the delay duration of a soft limiter involves balancing tradeoffs. If the delay is long, it affords the opportunity to sample and analyze more of the signal peaks in the audio signal (e.g., apply a smoothing function and perform root mean square analysis), improving the accuracy of the attenuation set by the limiter so that the analyzed peaks will be reduced to within the limits. This also provides the limiter more time to smoothly and gradually increase attenuation (i.e., use a longer attack). However, increasing the number of samples also increases the computational load on the limiter. A longer delay may also result in a cumulative system delay that is objectionable to a listener. In comparison, shortening the delay provides less time for the limiter to react, such that more peaks may pass through the limiter with insufficient attenuation (i.e., more peaks still outside the limits), which may saturate a downstream amplifier or other components and will result in increased distortion in the output of the system (and potentially, damage). Shortening the delay also reduce the ability of the soft limiter to smoothly and gradually increase the attenuation, resulting in increased distortion.

One solution to mitigate insufficient limiting by a soft limiter is to input the output of the soft limiter into a hard limiter, with the hard limiter clipping any attenuated peaks that are still outside the limits after passing through the soft limiter. While this solution may produce less overall distortion than a hard limiter alone, the distortion will typically be higher than would be produced by an "ideal" soft limiter that reliably maintains the signal within the design limits.

Another challenge in limiter design is how to handle multiple audio channels. Examples of systems with multiple channels include two-channel stereos and surround sound systems which commonly have five or more audio channels.

The conventional approach has been to provide one limiter per channel, setting the attenuation for each channel independently. However, it would be beneficial to use an aggregated analysis of all of the channels, determining an attenuation to be applied to the signals based on the largest signal peaks across the all of the channels. Such multi-channel limiting would improve a system's ability to accurately reproduce an original soundstage (i.e., the perceived three-dimensional placement of where sounds originated from when listening to a multi-channel audio recording).

FIG. 1 is a block diagram conceptually illustrating an example of a high performance multichannel limiter (MCL). The multichannel limiter design works for N-channel audio with N≥1 and is configured such that no peak will go over the predetermined peak threshold limit in any of the N-channels. Clipping is avoided, minimizing harmonic distortions. Moreover, latency due to look-ahead delay is kept small. As illustrated in the example in FIG. 1, there are two channels (N=2).

The multichannel limiter creates a gain control signal based on a maximum absolute value of the N-channel audio signals (i.e., the maximum peak out of all of the N-channels). Each of the N-channel audio signals is delayed by an amount of time "d" corresponding to "D" samples. Once a control signal is ready to implement level adjustment, the delayed audio is sent ahead to a control element at the exact moment that the control signal arrives to make the adjustment. The disclosed multichannel limiter 120 not only meets the requirement of being clipping-free and very low latency but also can be used to improve any type audio processing, such as three-dimensional audio enhancement, digital volume control (DVC), automatic gain control (AGC), and acoustic echo cancellation (AEC), to prevent audio from clipping.

When users of a multi-channel system are not provided facilities (e.g., a user interface) to separately adjust levels of front and rear channels, such multi-channel aggregation maintains the integrity of the original sound image/soundstage and maintain the balance between front and rear sound fields. For example, in a "5.1" surround sound system, a single multichannel limiter 120 (N=5) may be used for all five channels. The sub-woofer "0.1" channel may either be limited together with the five channels (i.e., N=6) or separately with a mono-channel limiter (limiter 120 with N=1). For the applications when users are provided such facilities and would like to adjust the front and rear channels differently, groups of channels may be handled by a single multi-channel limiter 120. For example, for "5.1" surround sound, a first stereo (N=2) multichannel limiter 120 may be used for the front left and front right channels, a second stereo multichannel limiter 120 may be used for the rear left and rear right channels, a first mono limiter 120 (N=1) may be used for the center channel, and a second mono limiter 120 may be used for the subwoofer channel. In the alternative, a three-channel limiter 120 (N=3) may be used for the front left, center, and front right channels.

In FIG. 1, when a user chooses to listen to audio content, they will may adjust the using volume control 112, which may be most any user interface, such as up-and-down volume buttons (e.g., physical buttons, virtual buttons displayed on a touch-sensitive user interface, etc.), a rotary knob (e.g., an analog rotary potentiometer, an optical rotary encoder, a virtual knob displayed on a touch-sensitive user interface, etc.), a volume slider, a speech-recognition-based spoken command to adjust the volume level, etc.

The volume level is output by the volume control 112 as a gain $g_1(n)$ 114, where "n" indicates the $n^{th}$ received samples or values received on the N channels. As such, "n" corresponds to a unit or block of time, such as a time of a signal sample in the analog domain or a discrete time in the digital domain. One increment of "n" may correspond to a step of one sample or one block of samples. The pre-amplifier stage 102 of the device with audio limiting 100 receives the N audio signals. As illustrated, N equals two, with the audio signals being a left stereo audio signal xa(n) 110*a* and a right stereo audio signal xb(n) 110*b*. The volume level (as a gain $g_1(n)$ 114) is applied to input audio signal xa(n) 110*a* by a multiplier 116*a*, producing an audio signal $xa_{in}(n)$ 118*a* having the user-adjusted volume. Likewise, the volume level (as a gain $g_1(n)$ 114) is applied to input audio signal xb(n) 110*b* by a multiplier 116*b*, producing an audio signal $xb_{in}(n)$ 118*b* having the user-adjusted volume. For example, the linear gain of pre-amplifier stage 102 may be from −10 dB to 10 dB.

The processing components of the device 100 with audio limiting may be analog circuits, digital circuits, digital-signal processing routines executed by a general-purpose computer or digital signal processor (DSP), or some combination thereof. If the system mixes analog and digital, analog-to-digital converters and/or digital-to-analog converters may be included at the various stages, as known in the art. Examples of the multipliers 116*a* and 116*b* (and other multipliers referred to herein) include physical amplification circuits such as operational amplifiers ("op-amps"), a software-based gain stage applied to a digital audio signal by digital signal processing, etc.

Figure 2A:
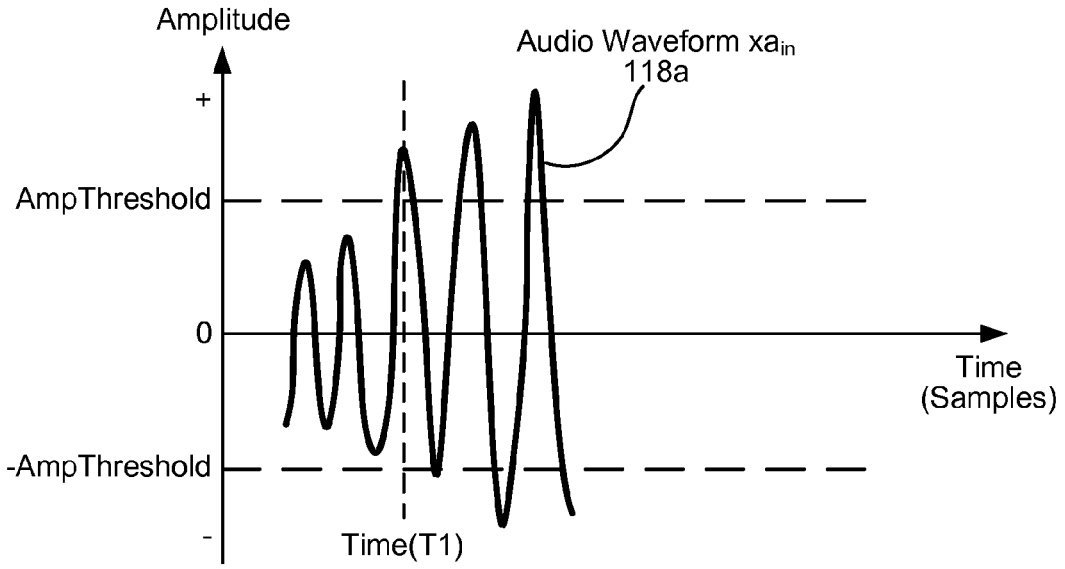
FIGS. 2A and 2B illustrate examples of left and right channel input waveforms that exceed a peak threshold.
Figure 2B:
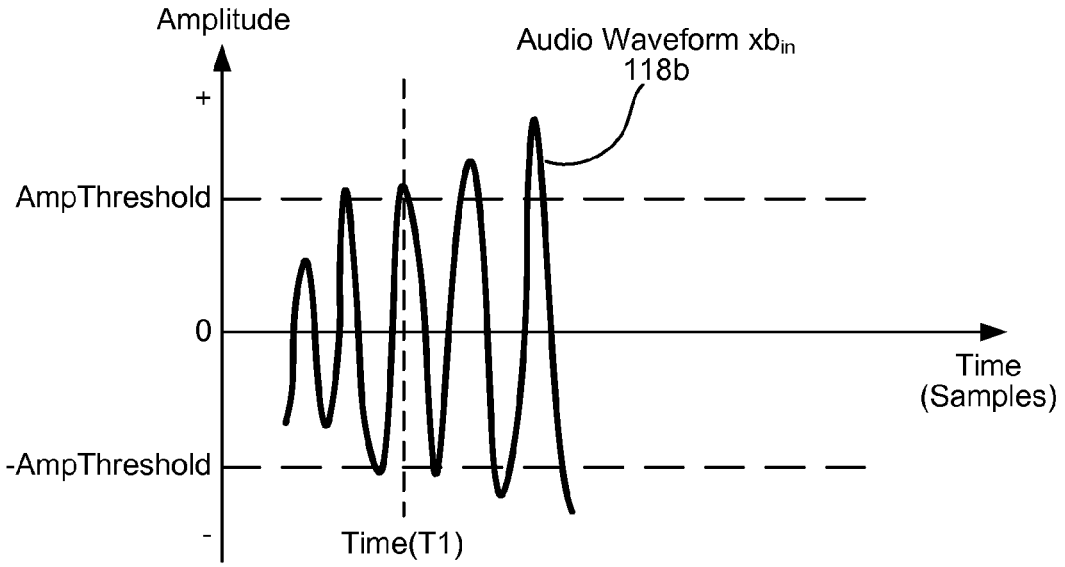
Figure 3A:
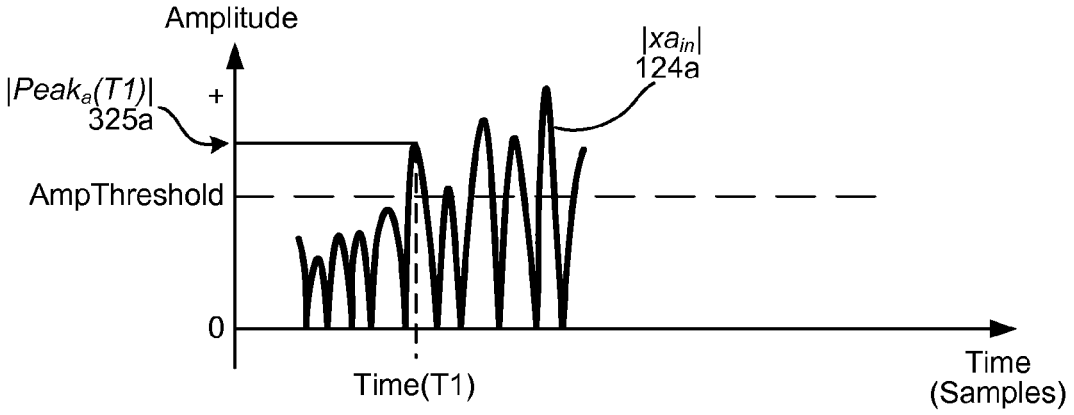
FIGS. 3A and 3B illustrate the absolute values of the waveforms in FIGS. 2A and 2B.
Figure 3B:
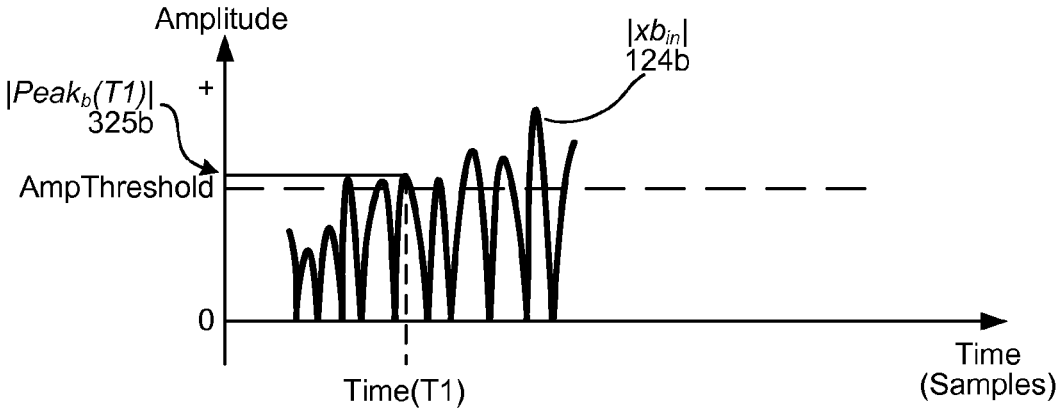

The volume-adjusted audio signals $xa_{in}(n)$ 118*a* and $xb_{in}(n)$ 118*b* are input into the multichannel limiter 120. FIGS. 2A and 2B illustrates examples of the volume-adjusted audio signals $xa_{in}(n)$ 118*a* and $xb_{in}(n)$ 118*b*. The positive and negative permissible amplitude threshold limits "AmpThreshold" demonstrate that peaks such as the peak at time "T1." The absolute values of these signals are determined by absolute value blocks 122*a* and 122*b*, with the rectified waveforms $|xa_{in}|$ 124*a* illustrated in FIG. 3A, and $|xb_{in}|$ 124*b* illustrated in FIG. 3B. A variable enclosed in symbols "||" indicates an absolute value. In the digital domain, the process may be performed by translating sample values relative to the center amplitude value (e.g., relative to the zero-crossing value). In the analog domain, an example of a circuit that may be used to determine absolute value is a full-wave bridge rectifier.

The amplitude magnitude of the rectified waveform $|xa_{in}|$ 124*a* is compared (e.g., by comparator 126*a*) with the permissible limit value AmpThreshold, which may be stored in or set by component 128 (e.g., a register storing a value, a voltage tunably set using an analog potentiometer, etc.). Likewise, the amplitude magnitude of the rectified waveform $|xb_{in}|$ 124*b* is compared (e.g., by comparator 126*b*) with the permissible limit value AmpThreshold. Each comparator will output a "1" for "true" if the amplitude magnitude of the respective rectified signal at time "n" is greater than AmpThreshold. If the amplitude magnitude of the input rectified signal is not greater than AmpThreshold, the respective comparator will output a "0" for "false." The output of each comparator 126*a*/126*b* is input into OR logic 130. If either rectified signal 124*a*/124*b* at time "n" exceeds the limit AmpThreshold, the OR logic 130 will output a "1" for true, indicating that application of downward compression is needed. If each input rectified signal has an amplitude not exceeding the limit AmpThreshold, then the OR logic 130 will output a "0" for false. Thus, the OR logic determines whether the amplitude magnitude of any |Peak(n)| is greater than AmpThreshold, corresponding to signal 132 in FIG. 1.

If downward compression is needed (signal 132 being true), then a determination is made of the maximum absolute value at time n. The component Max(n) 134 receives the absolute value signals $|xa_{in}|$ 124*a* and $|xb_{in}|$ 124*b* and determines which signal peak is larger. For example in FIGS. 3A and 3B at time T1, the signal value |Peaka(T1)| 325*a* is greater than the signal value |Peakb(T2)| 325*b*. This, the component Max(n) 134 outputs a value MaxPeak 136 that equals |Peaka(T1)| 325*a* since it is largest.

The value MaxPeak is used to determine the temporary gain to be applied to the volume-adjusted audio signals in order to downwardly compress the signals so that no signal exceeds the limits (i.e., +/−AmpThreshold). The temporary gain for the look-ahead state is determined by dividing the limit AmpThreshold by the value MaxPeak, such as is performed by divider 140.

Figure 4A:
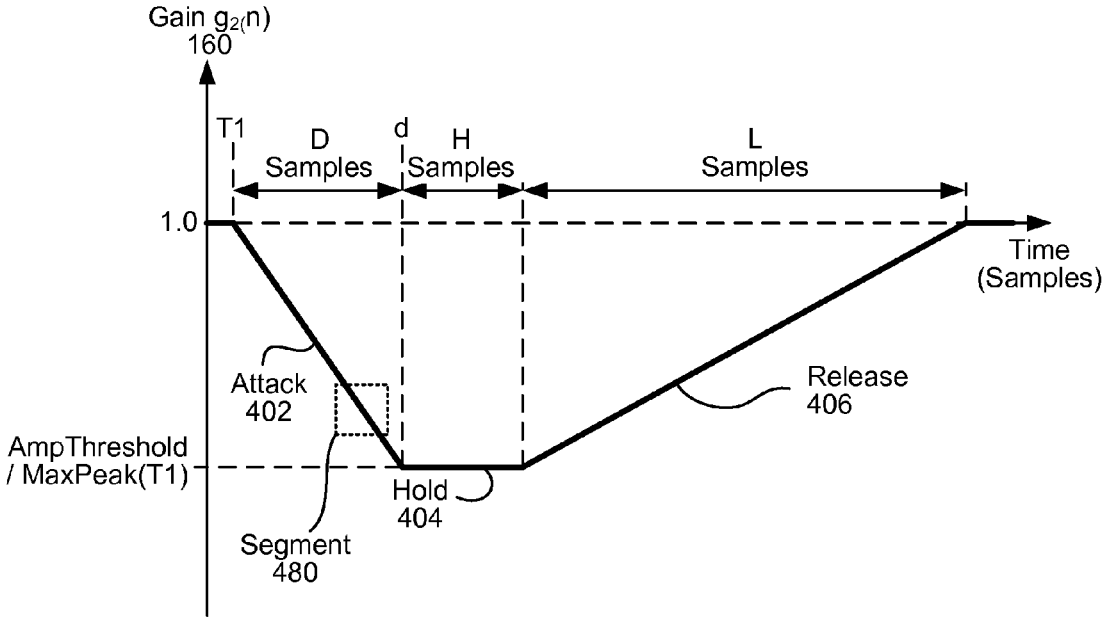
FIG. 4A illustrates an example of a gain curve including attack, hold, and release states.

After the limiter 120 searches the maximum absolute value (i.e., MaxPeak 136) among the N channels, a gain controller 150 of the limiter 120 will modify the samples around the current input samples in three states (stages) if the selected peak is larger than the specified amplitude threshold limit (i.e., AmpThreshold). Referring to FIG. 4A, the three states (stages) for the limiter processing are an attack state 402 having a duration of "D" samples, a hold state 404 having a duration of "H" samples, and a release state 406 having a duration of "L" samples.

The gain curve in FIG. 4A is based on an example where the states are determined using linear interpolation. The D samples of the attack state 402 may be equal in number to the number of samples stored in a first-in first-out (FIFO) circular buffer 162 which stores the N volume-adjusted channels (e.g., 118*a*, 118*b*), providing the delay time of "d." The duration L of the release state length is larger than the duration of the attack state D, and longer than the duration of the hold state L.

The attack state 402 corresponds to the look-ahead-period which is before the current input samples are output. In this state, the time-varying gain variable $g_2(n)$ 160 is gradually changing from 1.0 to (AmpThres/MaxPeak) which is less than 1.0, so as to attenuate the audio before the loudest peak is hit.

The hold state 404 occurs immediately after the current input samples. In this state, the variable gain $g_2(n)$ 160 equals to (AmpThres/MaxPeak).

The release state 406 is immediately after the holding-period. The time-varying variable gain $g_2(n)$ 160 is gradually recovered from (AmpThres/MaxPeak) to 1.0 for the attenuation to rebound back in the release state.

The time variable gain $g_2(n)$ 160 is applied to the time-delayed audio signals $xa_{in}(n\text{-}d)$ 164*a* and $xb_{in}(n\text{-}d)$ 164*b* by multipliers 166*a* and 166*b*, generating the limited audio output signals $xa_{out}(n\text{-}d)$ 170*a* and $xb_{out}(n\text{-}d)$ 170*b*. The delay time "d" corresponds to the number of samples D stored in the circular buffer 162 divided by the sampling rate of the audio signals. With the look-ahead length provided by circular buffer 162 being D samples, the output audio has D samples' delay with respect to the input audio.

When it is in look-ahead state applying downward compression, the value of AmpThreshold/MaxPeak 140 is less than 1.0. The gain $g_2(n)$ 160 for look-ahead period can be interpolated between 1.0 and AmpThreshold/MaxPeak either linearly or nonlinearly. To reduce the computational complexity, linear interpolation is adopted in the illustrated examples. However, non-linear gain curves may be computed by equation, or determined based on values in a stored table.

Figure 4B:
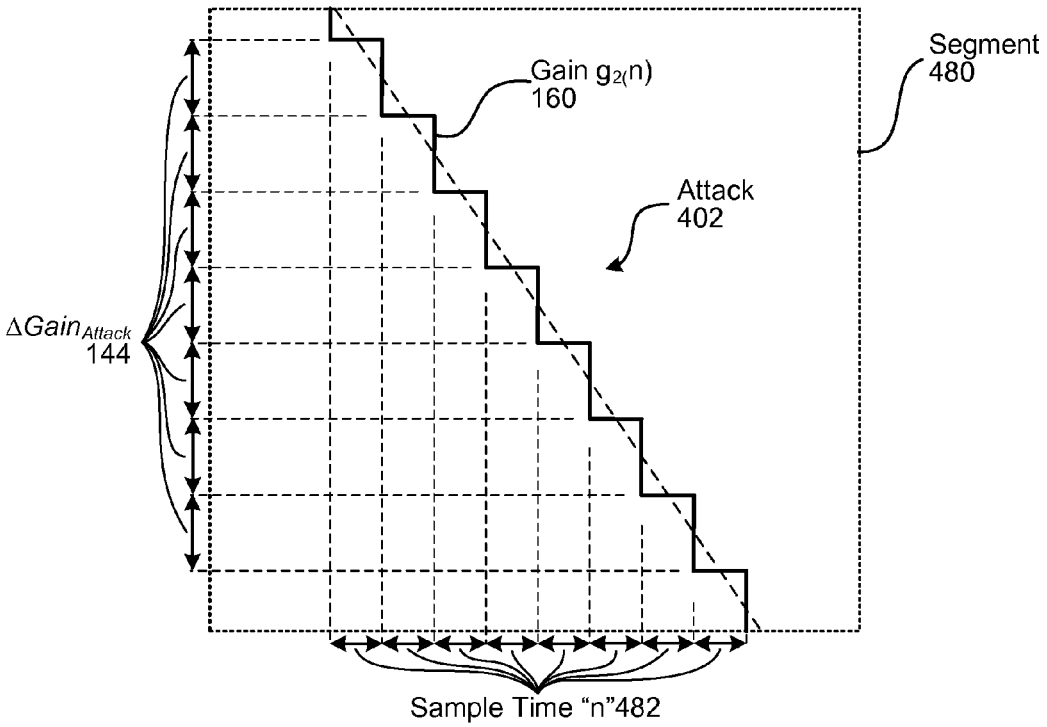
FIG. 4B is an expanded view of a segment of the attack curve from FIG. 4A.
Figure 5A:
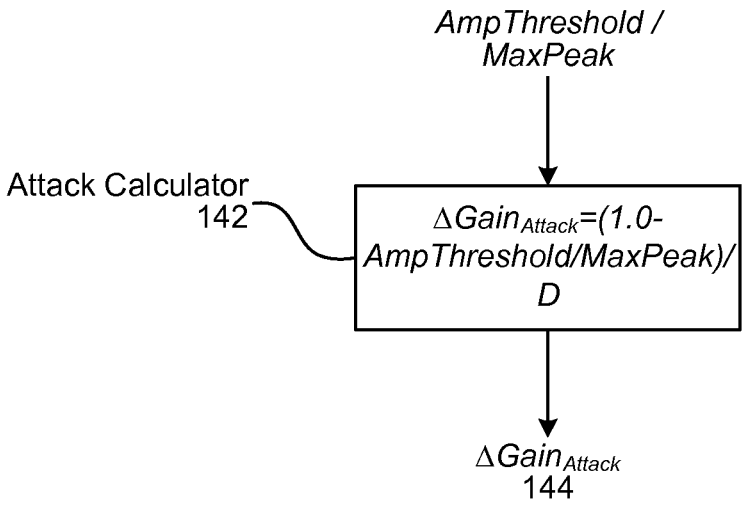
FIGS. 5A and 5B illustrate how linear interpolation may be used to generate attack and release gain curves in example in FIG. 1

During the attack phase 402, the gain $g_2(n)$ 160 is decremented for each sample by a delta gain value $\Delta Gain_{Attack}$ 144 as illustrated in FIG. 4B, which expands on a segment 480 of the gain $g_2(n)$ during the attack state 402. As illustrated in FIG. 5A, the value $\Delta Gain_{Attack}$ 144 may be determined by an attack calculator 142, and is equal to (1.0−AmpThreshold/MaxPeak)/D.

In the holding state 404, the gain $g_2(n)$ 160 is equal to AmpThreshold/MaxPeak for H samples.

Immediately after the holding state 404 ends, the release state 406 starts. The release length is L samples with L>>D and L>>H. The gain for release period 406 may be interpolated between 1.0 and AmpThreshold/MaxPeak either linearly or nonlinearly. To reduce the computational complexity, linear interpolation is adopted in the illustrated examples. However, non-linear gain curves may be computed by equation, or determined based on values in a stored table.

Figure 5B:
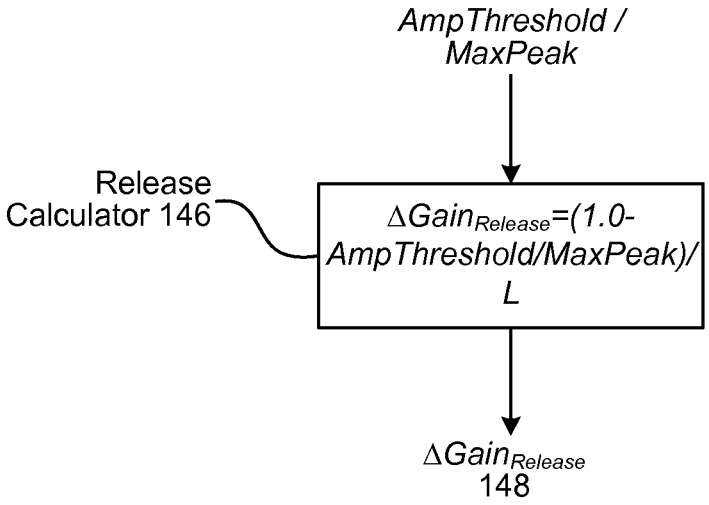

During the release state 406, the gain $g_2(n)$ 160 is incremented for each sample by a delta gain value $\Delta Gain_{Release}$ 148. As illustrated in FIG. 5B, the value $\Delta Gain_{Release}$ 148 may be determined by a release calculator 146, and is equal to (1.0−AmpThreshold/MaxPeak)/L.

Figure 6:
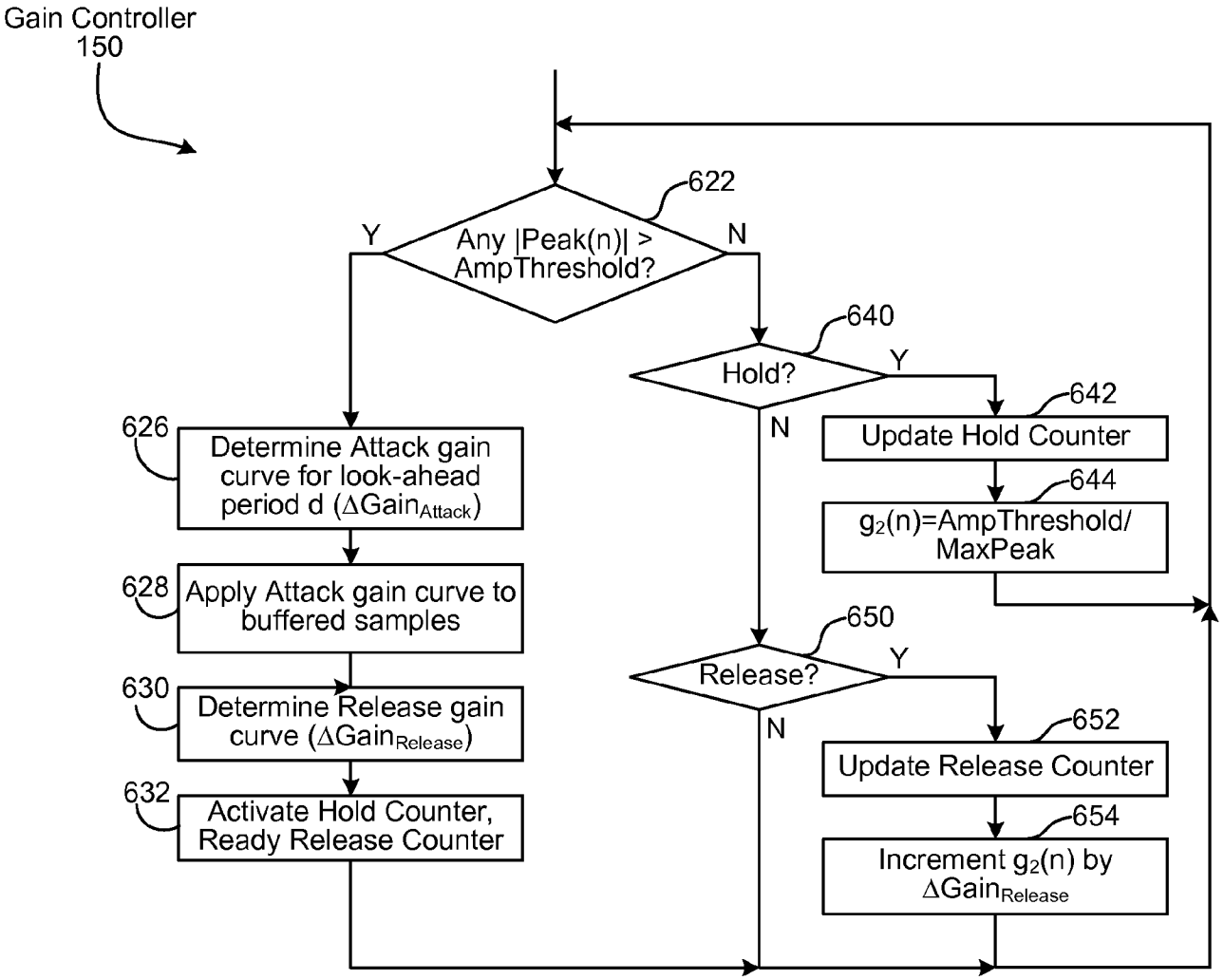
FIG. 6 illustrates a process that may be used by the gain controller in the audio limiting system.

FIG. 6 illustrates a process that may be used by the gain controller 150, which may work in conduction with an attack counter 152, a hold counter 154, and a release counter 156. The attack counter may be configured to count up to D or countdown to D. The hold counter 154 may be configured to count up to H or countdown to H. The release counter 156 may be configured to count up to L or countdown to L.

The gain controller 150 determines (622) if the absolute value of any of the N signals is greater than the limit threshold AmpThreshold (e.g., based on the value of signal 132). If true (622 "Yes"), the gain controller 150 determines (626) the attack gain curve 402 for the look-ahead period d (e.g., based on $\Delta Gain_{Attack}$ 144). The gain controller 150 applies the attack gain curve 402 to the buffered D samples as they are output from the buffer 162. The attack counter 152 may be used to keep track of the start and end of the attack state period.

The gain controller 150 also determines (630) the release gain curve 406 for the release state (e.g., based on $\Delta Gain_{Release}$ 148). After the attack state ends, the gain controller 150 resets and actives (632) the hold counter 154, and resets the release counter 156. After the hold state 404 has been applied for the duration of H samples, the release counter will be activated and the release gain curve applied to the output.

If none of the absolute values of any of the N signals is greater than the limit threshold AmpThreshold (622 "No"), and the controller 150 is in the hold state (640 "Yes"), then the hold counter 154 is updated 642 while the variable gain $g_2(n)$ is held (644) at AmpThreshold/MaxPeak. Otherwise, if the controller is in the release state (650 "Yes"), then the release counter 156 is updated (652) and the variable gain $g_2(n)$ is incremented (654) by $\Delta Gain_{Release}$ 148. If none of the absolute values of any of the N signals is greater than the limit threshold AmpThreshold (622 "No") and the controller 150 is not in the hold state or release state, than the variable gain $g_2(n)$ will be equal to 1.0 (i.e., unchanged).

Figure 7A:
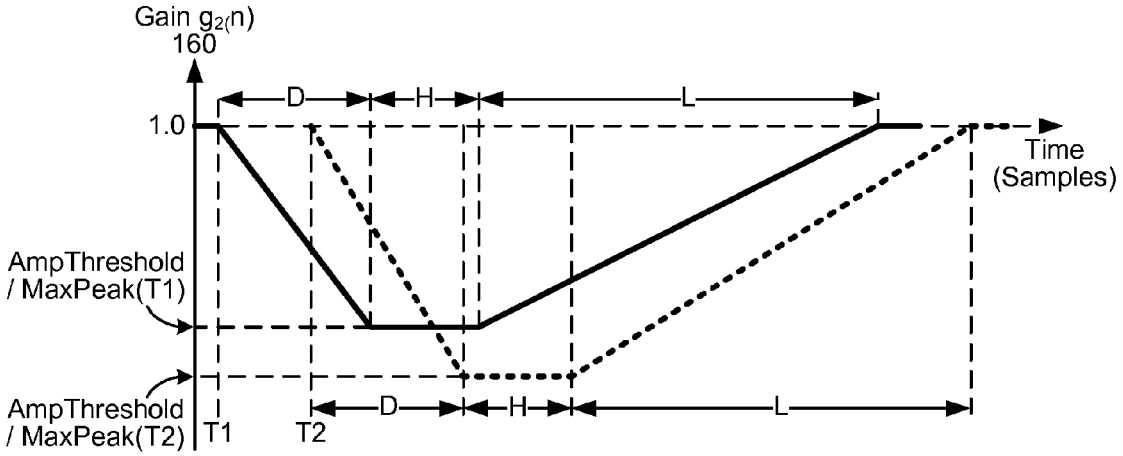
FIGS. 7A and 7B illustrate how the gain controller may combine gain curves from peaks that exceed the threshold at different times.

If a peak exceeding the limit AmpThreshold is detected in a subsequent sample (e.g., at time T2) after the downward compression has been calculated for an earlier peak (e.g., at time T2), then the gain controller 150 may combine the gain curves so as to select the gain value that will result in the greater reduction of gain for any given sample. For example, in FIG. 7A, a first gain curve to downwardly compress the audio signals is determined at time T1 based on a value AmpThreshold/MaxPeak(T1). A second gain curve to downwardly compress the audio signals is determined at time T2 based on a value AmpThreshold/MaxPeak(T2) is illustrated by a broken line, but will not be applied.

Figure 7B:
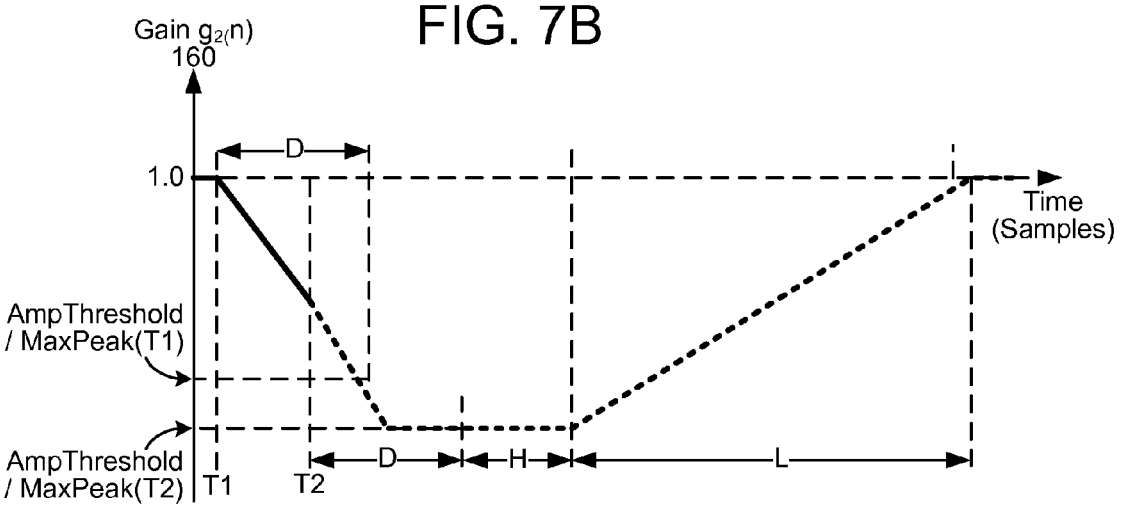

Instead, FIG. 7B illustrates an example of how the variable gain $g_2(n)$ 160 combines features of the first and second gain curves to select the greater rate of reduction in attenuation for each output sample. Although the look-ahead length D of the buffer 162 is small, the actual attack time is longer than D due to the cumulative attenuation. As illustrated, $\Delta Gain_{Attack}$(T1) is applied as the attack rate from time T1 to T2. At time T2, the attack counter 152 restarts, and since $\Delta Gain_{Attack}$(T2) is larger than $\Delta Gain_{Attack}$(T1) (as a result of AmpThreshold/MaxPeak(T2) being larger than AmpThreshold/MaxPeak(T1), the gain controller 150 selects/adopts $\Delta Gain_{Attack}$(T2) and continues attenuating until reaching AmpThreshold/MaxPeak(T2). The gain $g_2$ 160 may then maintained at the AmpThreshold/MaxPeak (T2) level for a remainder of the attack time D.

As a result, applied attenuation provided by gain $g_2(n)$ 160 at time (T1+d) is more than is necessary to compress the peak from time T1 (i.e., MaxPeak(T1) 136) that triggered the initial attack when it is output from the circular buffer 162. Further, when the peak from time T2 (i.e., MaxPeak (T2) 136) that triggered the more aggressive attack is output after the time delay d, the attenuation applied to the time-delayed signals (164) compresses the peaks in the output (170) to within the AmpThreshold level limits. After the attack period D expires, absent another MaxPeak 136), the hold period 404 begins as before at the AmpThreshold/MaxPeak(T2) level.

Other approaches may be used to determine/select the attack rate value of $\Delta Gain_{Attack}$ when there are a series of MaxPeaks. For example, in the linear domain, the existing/prior attack rate applied by the gain controller 150 may be multiplied by the new attack rate attack rate provided by the attack calculator 142, with the resulting product being used as a new applied attack rate. Similarly, in the logarithmic domain (e.g., decibels), the prior attack rate applied by the gain controller 150 and the new attack rate provided by the attack calculator 142 may be added together, with the resulting sum being uses as a new applied attack rate.

The attack counter 152 may restart each time the signal |Peak(n)|>AmpThreshold 132 indicates that a new MaxPeak 136 exists. If a new MaxPeak (T2) is smaller than a prior MaxPeak(T1), the gain controller 150 will maintain the gain $g_2$ 160 at or below AmpThreshold/MaxPeak(T1) to compress the peak corresponding to MaxPeak(T1) when it is output from the circular buffer 162 to assure that the output 170 is held within the AmpThreshold level limits. The gain controller 150 will thereafter maintain the gain $g_2$ 160 at or below AmpThreshold/MaxPeak(T2) to compress the peak corresponding to MaxPeak(T2) when it is output from the circular buffer 162 to assure that the output 170 is held within the AmpThreshold level limits.

One approach, since AmpThreshold/MaxPeak(T1) corresponds to a smaller gain $g_2$ 160 than AmpThreshold/MaxPeak(T2) (i.e., corresponds to a larger applied attenuation) is to select the larger attenuation produced by AmpThreshold/MaxPeak(T1) for the new target gain at time T2, such that the gain $g_2$ 160 is maintained at AmpThreshold/MaxPeak (T1) when the peak corresponding MaxPeak(T2) 136 is output from the circular buffer 162. When the hold period 404 at time T2+d, the gain $g_2$ 160 continues to be held at AmpThreshold/MaxPeak(T1).

If a new MaxPeak(T2) 136 occurs during the hold 404 or release state 406 based on a previous MaxPeak(T1) 136, the gain $g_2$ 160 is held at or below the target level AmpThreshold/MaxPeak(T2) until at least time T2+d, applying $\Delta Gain_{Attack}$(T2) to reach that target. If the current gain $g_2$(T2) 160 at time T2 is smaller than the target level AmpThreshold/MaxPeak(T2), then gain controller 150 may select the current gain the $g_2$(T2) 160 as the new target gain, minimizing fluctuations in output attenuation while assuring that when the peak corresponding to MaxPeak(T2) 136 is output from the circular buffer 162, compression is sufficient to hold the output 170 to within AmpThreshold level limits.

By virtue of limiting all of the N channels based on AmpThreshold/MaxPeak, the multichannel limiter 120 effectively guarantees that no peak will go over the predetermined peak threshold (i.e., AmpThreshold) in the N-channel audio. Since the samples/blocks are sampled during the look-ahead period but the hold and release states occur after the look-ahead period, the time delay introduced by the circular buffer 162 may be kept small.

Although illustrated for two channels, additional channels can be added simply by duplicating the functions that are individual to a channel for each additional channel. Likewise, the limiter 120 also works for a single channel arrangement (obviating the need for OR logic 130).

The larger the value of D, which corresponds to the length of the look-ahead buffer 162 and the duration of the attack state 402, the more computationally complex the multichannel limiter 120 becomes. However, changing the duration H of the hold state 404 and the duration L of the release state 406 does not affect computational complexity. As a quantitative example, the look-ahead time D may be between 0.5 ms and 2.5 ms, the holding time H may be between 0.4 ms and 1 ms, and the release time L may be between 70 ms and 300 ms.

The value of the limit AmpThreshold may be adjusted based on the requirements of downstream components after the limiter, such as a digital-to-analog converter (DAC) that receives the output signal(s) 170. The value of AmpThreshold may be adjusted over time to reduce the amount of compression applied by the limiter 120, may be adjusted manually, may be adjusted based on parameters identified for a particular source, etc.

An example of an existing single-channel peak soft limiter (PSL) is disclosed in "Smoothing of the Control Signals Without Clipped Output in Digital Peak Limiters" by Perttu Hämäläinen in the Proceedings of the 5th International Conference on Digital Audio Effects (DAFx-02), Hamburg, Germany, pp. 195 to 198 (2002), which is incorporated by reference herein for background. This PSL is generally regarded as being as a good limiter solution, and the disclosed algorithm is believed to be widely used by limiters in contemporary electronics. In comparison to tracking peaks as the samples are received in the present design, the PSL tracks peaks by using a smoothing function which acts as a low pass filter, such that the detected amplitude maximums may be different from the actual peaks.

As the PSL needs sufficient time (e.g., 16 ms) to compute a moving average for the gain calculation, using signal processing hardware with the same computational capabilities, the same inputs, the same thresholds, etc., the PSL algorithm introduces 6 ms of latency in the audio path, whereas the multichannel limiter 120 similarly configured has a latency of 2.5 ms. This difference is important, as 6 ms (particularly if combined with other latencies in an audio system) may introduce enough delay that a user may find it undesirable (e.g., if the latency between an audio feed and a video feed are different).

Also, since the PSL may output some peaks that are above the peak thresholds due to the smoothing function and the used of the moving average, a hard limiter should be used at the output of the PSL, increasing distortion. For example, setting the peak threshold of the PSL at 0.999, the maximum peaks of the PSL output are between 1.23 and 1.73 for the input volumes between 6.5 dB and 23.5 dB, where an output of 0.999 corresponds to the threshold limit. These peak values are much more than 0 dBFS (Decibels Relative to Full Scale), which can result in clipping artifacts.

Test results were compared for the PSL and the multi-channel limiter 120 set with the same peak threshold value 0.999, the same input volumes, using the same audio files. The maximum peaks of the PSL were between 1.0016 and 1.0092 for input volumes between 6.5 dB and 23.5 dB, while the multichannel limiter 120 had outputs with maximum peaks of 0.998993 for all input volumes.

In addition, in subjective listening tests performed using the PSL and the multi-channel limiter 120 using raw audio data, the multi-channel limiter was preferred according to metrics of perceived distortion and tonal balance for a majority of the audio source files by most listeners. The output of the multi-channel limiter 120 was also judged to sound "softer" than that of the PSL.

The multichannel limiter 120 guarantees that no peak will go over the predetermined peak threshold in the N-channel audio. Therefore the multichannel limiter 120 can prevent any clipping from occurring in the audio, whereas the PSL cannot.

In most of the examples above, the multichannel limiter 120 is described in terms of sample-by-sample processing. However, the multichannel limiter 120 may instead use block-by-block processing to reduce the computational complexity.

Figure 8:
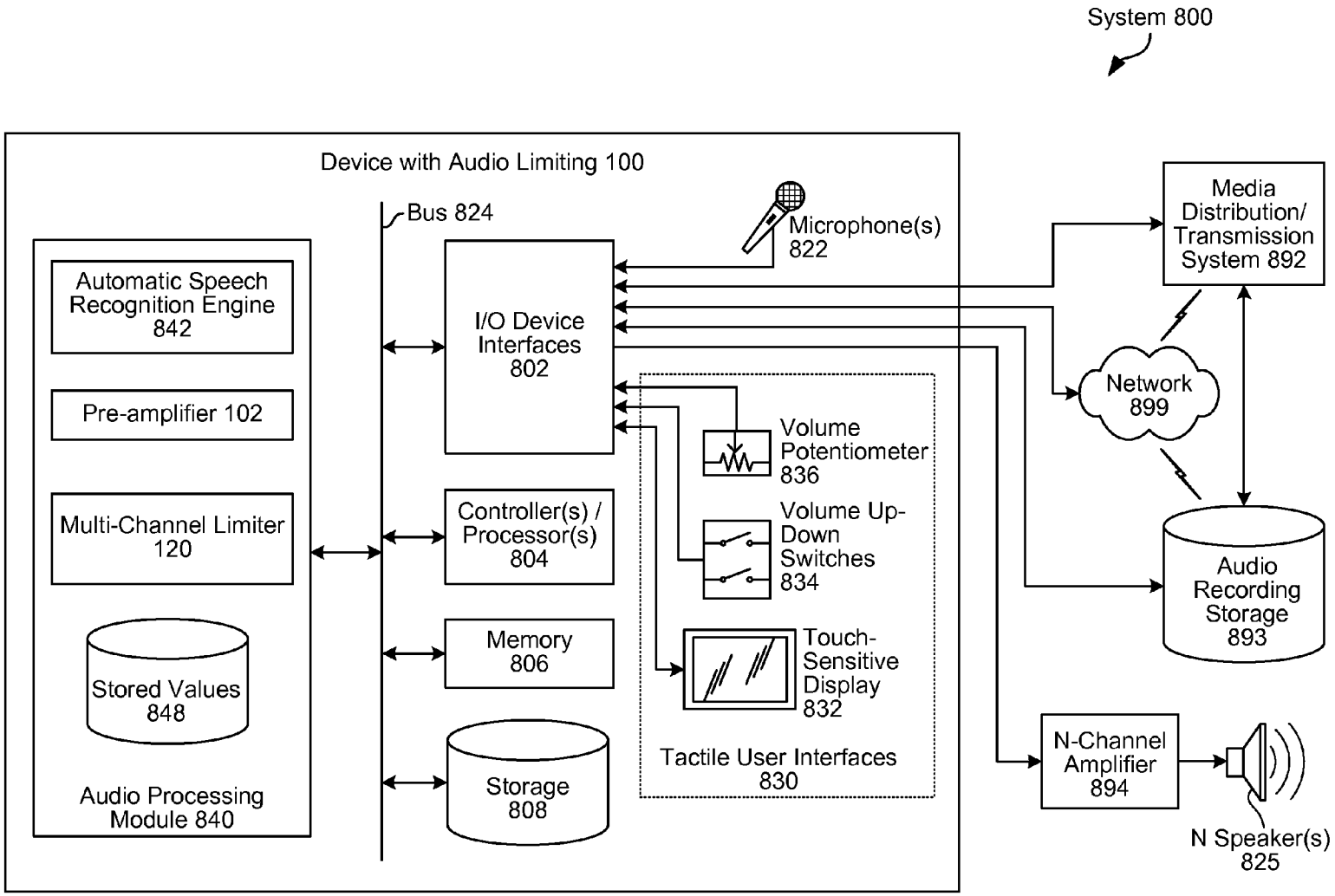
FIG. 8 is a block diagram conceptually illustrating example components of a system utilizing the audio limiting device.

FIG. 8 is a block diagram conceptually illustrating example components of a system 800 utilizing the device with audio limiting 100. In operation, the system 800 may include computer-readable and computer-executable instructions that reside in the memory 806 and/or storage 808 of the device 100 including the multi-channel limiter 120, as will be discussed further below.

As illustrated in FIG. 8, the system 800 may include microphone(s) 822 to capture audio material and audio recording storage 893 to store the resulting audio material, with the multi-channel limiter 120 adjusting the stored levels/dynamic range of the captured audio material. The system 800 may also include an N-channel amplifier 894 and associated speaker(s) 825, with the limiter 120 adjusting the levels/dynamic range of the audio material output by the speaker(s) 825. The system 800 may also include a media distribution/transmission system 892, which may distribute audio material stored in audio recording storage 893. The media distribution/transmission system 892 may also provide the device 100 with audio media, with the limiter 120 adjusting the levels/dynamic range of the audio material for playback. Other audio media sources may also be included.

The device 100 including the limiter 120 may connect to the various media sources, distribution systems, and/or media storage systems directly or via one or more networks 899. The connections between these various media sources, distribution systems, and/or media storage systems may be in a digital format, an analog format, or a combination thereof. All or portions of the various media sources, distribution systems, and/or media storage systems of the system 800 may be included in a single device such as integrated within the device 100, or broken up across multiple devices.

The device 100 may include one or more user interfaces by which the gain $g_1(n)$ 114 of the volume control 112 may be set. Examples of such user interfaces include tactile user interfaces 830 and non-tactile user interfaces such as the automatic speech recognition engine 842 of the audio processing module 840. Examples of tactile user interfaces 830 include a touch-sensitive display 832 with may provide a graphical user interface (GUI), up-down switches 834, and a rotary or slide potentiometer 836.

The various components of the system may connect to the device 100 directly, or through input/output device interfaces 802 via a bus 824. If the limiter 120 is digital and the received audio material is analog, digital-to-analog conversion may be included within the input/output device interfaces 802 or as a front-end process of the audio processing module 840. Likewise, if the limiter 120 is digital and the output is to be analog, analog-to-digital conversion may be included within the input/output device interfaces 802 or as a back-end process of the audio processing module 840.

The address/data bus 824 may convey data among components of the device 100. As already noted, each component within the device 100 may also be directly connected to other components in addition to (or instead of) being connected to other components across the bus 824.

The device 100 may include one or more controllers/processors 802, that may each include a central processing unit (CPU) and/or a digital signal processor (DSP) for processing data and computer-readable instructions, and a memory 806 for storing data and instructions. The memory 806 may include volatile random access memory (RAM), non-volatile read only memory (ROM), non-volatile magnetoresistive (MRAM) and/or other types of memory. The device 100 may also include a data storage component 808, for storing data and controller/processor-executable instructions (e.g., instructions to perform the processes and calculations performed by the limiter 120 and/or the automatic speech recognition engine 842). The data storage component 808 may include one or more non-volatile storage types such as magnetic storage, optical storage, solid-state storage, etc. The device 100 may also be connected to removable or external non-volatile memory and/or storage (such as a removable memory card, memory key drive, networked storage, etc.) through the input/output device interfaces 802.

Computer instructions for operating the device 100 and its various components may be executed by the controller(s)/processor(s) 804, using the memory 806 as temporary "working" storage at runtime. The computer instructions may be stored in a non-transitory manner in non-volatile memory 806, storage 808, or an external device. Alternatively, some or all of the executable instructions may be embedded in hardware or firmware in addition to or instead of software.

A variety of components may be connected through the input/output device interfaces 802, and a variety of communication protocols may be supported. For example, the input/output device interfaces 802 may also include an interface for an external peripheral device connection such as universal serial bus (USB), FireWire, Thunderbolt or other connection protocol. The input/output device interfaces 802 may also include a connection to one or more networks 899 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc. In addition to wired and/or built-in arrangements, the microphone(s) 822 and/or speaker(s) 825 may connect wirelessly, such an arrangement where the microphone(s) 822, amplifier 894, and/or speaker(s) 825 are part of a headset connected to the device 100 via one of these wireless connections. Through the network 899, the system 800 may be distributed across a networked environment.

The device 100 includes the audio processing module 840. The module 840 may include the automatic speech recognition (ASR) engine 842 used by the user to communicate volume level changes, the pre-amplifier 102, and the limiter 120. Values such as the AmpLimit Threshold value, and the number of samples for the attack state "D", the hold state "H", and the release state "L" may be stored in a storage element 848, which may be a stand-alone storage element or elements, a portion of memory 806, a portion of storage 808, etc. The circular buffer 162 of the limiter 120 may comprise a standalone delay element, a portion of storage element 848, a portion of memory 806, a portion of storage 808, etc.

Multiple devices 100/892/894 and media storages 893 may be employed in a single audio system 800. In such a multi-device system, components in different device may perform different aspects of the audio processing module 840, such as performing ASR 842 on one device 100 and including the multi-channel limiter 120 on another device 100. Multiple devices may include overlapping components. The components of the system 800 as illustrated in FIG. 8 are exemplary, and may be included in a stand-alone device or may be included, in whole or in part, as a component of a larger device or system.

The concepts disclosed herein may be applied within a number of different devices and computer systems, including, for example, general-purpose computing systems, digital signal processing, multimedia set-top boxes, televisions, stereos, radios, digital media playback devices such as "smart" phones, MP3 players, tablet computers, and personal digital assistants (PDAs), audio distribution and broadcasting system, and audio recording systems.

The disclosed examples are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers, digital signal processing, and audio processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. In addition, one or more of the ASR engine 842 and components of the pre-amplifier 102 and limiter 120 may be implemented as firmware or as a state machine in hardware. For example, the gain controller 150 may be implemented as a state machine on an application specific integrated circuit (ASIC), a digital signal processor (DSP), a field programmable gate array (FPGA), or some combination thereof.

As used in this disclosure, the term "a" or "one" may include one or more items unless specifically stated otherwise. Further, the phrase "based on" is intended to mean "based at least in part on" unless specifically stated otherwise.

What is claimed is:

1. A method for limiting signal peaks in corresponding audio signals, the method comprising:

receiving a first audio signal for a left stereo audio channel;

receiving a second audio signal for a right stereo audio channel;

generating a first delayed audio signal by delaying the first audio signal by a delay time after receiving the first audio signal;

generating a second delayed audio signal by delaying the second audio signal by the delay time after receiving the second audio signal;

determining that a first amplitude magnitude of a first peak in the first audio signal received at a first time exceeds an amplitude threshold;

determining a first target gain that is equal to the amplitude threshold divided by the first amplitude magnitude;

applying a variable gain to the first delayed audio signal by multiplying the first delayed audio signal by the first target gain;

applying the variable gain to the second delayed audio signal by multiplying the second delayed audio signal by the first target gain, the variable gain including an attack region and a release region, wherein:

the attack region is applied to a first portion of the first delayed audio signal corresponding to a look-ahead period leading up to and including the first peak, the first portion having been received at or before the first time, the variable gain being gradually reduced in the attack region from an original gain to the first target gain to attenuate the first delayed audio signal so that by a second time when the first peak is output after the delay time, the variable gain is equal to the first target gain;

the release region is applied to a second portion of the first delayed audio signal that is output after the second time, the variable gain being gradually increased from the first target gain to the original gain over a release time period that is longer than the delay time;

determining a second amplitude magnitude of a second peak in the first audio signal at a third time exceeds the amplitude threshold;

determining a second target gain to attenuate the second amplitude magnitude to be within the amplitude threshold; and gradually reduce the variable gain to the second target gain during a third duration beginning at the third time.

2. The method of claim 1, further comprising:

determining the first amplitude magnitude as a first absolute value of the first peak in the first audio signal received at the first time;

determining the second amplitude magnitude as a second absolute value of the second peak in the second audio signal received at the first time;

comparing the first amplitude magnitude and the second amplitude magnitude to determine which is larger, wherein the first target gain is based on the first amplitude magnitude instead of the second amplitude magnitude due to the first amplitude magnitude being larger.

3. The method of claim 1, wherein the variable gain further comprises a hold region between the attack region and the release region, the hold region being applied to a third portion of the first delayed audio signal output after the second time, the variable gain in the hold region being held at the first target gain, and the release time period is longer than a hold time period that is a duration of the hold region.

4. A computing device comprising:

a processor;

a memory including instructions operable to be executed by the processor to perform a set of actions to configure the processor to:

store a first audio signal to create a first delayed audio signal, the first delayed audio signal to be output after a delay;

multiply the first delayed audio signal by a variable gain;

determine that a first amplitude magnitude of a first peak in the first audio signal at a first time exceeds an amplitude threshold;

determine a first target gain to attenuate the first amplitude magnitude to be within the amplitude threshold;

gradually reduce the variable gain from an initial gain to the first target gain over a first duration beginning at the first time, the variable gain to be less than or equal to the first target gain by a second time when the first peak is output after the delay;

gradually increase the variable gain to the initial gain after the second time over a second duration, the second duration being longer than the delay;

determine that a second amplitude magnitude of a second peak in the first audio signal at a third time exceeds the amplitude threshold;

determine a second target gain to attenuate the second amplitude magnitude to be within the amplitude threshold; and gradually reduce the variable gain to the second target gain during a third duration beginning at the third time.

5. The computing device of claim 4, wherein the instructions further configure the processor to:

store a second audio signal to create a second delayed audio signal, the second delayed audio signal to be output after the delay;

multiply the second delayed audio signal by the variable gain;

determine that a second amplitude magnitude of a second peak amplitude of the second audio signal at the first time exceeds the amplitude threshold;

compare the first amplitude magnitude and the second magnitude; and determine that the first amplitude magnitude is larger than the second magnitude, wherein the first target gain is based on the first amplitude magnitude in response to determining that the first magnitude is larger than the second amplitude magnitude.

6. The computing device of claim 5, wherein the instructions further configure the processor to:

determine the first amplitude magnitude based on an absolute value of the first audio signal; and determine the second amplitude magnitude based on an absolute value of the second audio signal.

7. The computing device of claim 4, wherein the instructions further configure the processor to:

maintain the variable gain at the first target gain for a third duration after the second time, prior to the gradual increase of the variable gain to the initial gain.

8. The computing device of claim 7, wherein:

the first duration is equal to the delay, which is between 0.5 ms and 2.5 ms, the second duration is between 70 ms and 300 ms, and the third duration corresponding is between 0.4 ms and 1 ms.

9. The computing device of claim 4, wherein the initial gain corresponds to a unity gain, such that an amplitude of the first delayed audio signal is unchanged when multiplied by the unity gain.

10. The computing device of claim 9, wherein the first target gain, relative to the unity gain, is equal to the amplitude threshold divided by the first amplitude magnitude.

11. The computing device of claim 4, wherein the third time occurs after the first time and before an end of the second duration;

the variable gain at the third time is greater than the second target gain; and the variable gain is less than or equal to the second target gain by a fourth time when the second peak is output after the delay.

12. The computing device of claim 4, wherein the instructions further configure the processor to:

determine a rate to gradually reduce the variable gain from the initial gain to the first target gain by linear interpolation.

13. A method comprising:

storing a first audio signal to create a first delayed audio signal, the first delayed audio signal to be output after a delay;

multiplying the first delayed audio signal by a variable gain;

determining that a first amplitude magnitude of a first peak in the first audio signal at a first time exceeds an amplitude threshold;

determining a first target gain to attenuate the first amplitude magnitude to be within the amplitude threshold;

gradually reducing the variable gain from an initial gain to the first target gain over a first duration beginning at the first time, the variable gain to be less than or equal to the first target gain by a second time when the first peak is output after the delay;

gradually increasing the variable gain to the initial gain after the second time over a second duration, the second duration being longer than the delay;

determining that a second amplitude magnitude of a second peak in the first audio signal at a third time exceeds the amplitude threshold;

determining a second target gain to attenuate the second amplitude to be within the amplitude threshold; and gradually reducing the variable gain to the second target gain during a third duration beginning at the third time.

14. The method of claim 13, further comprising:

storing a second audio signal to create a second delayed audio signal, the second delayed audio signal to be output after the delay;

multiplying the second delayed audio signal by the variable gain;

determining that a second amplitude magnitude of a second peak amplitude of the second audio signal at the first time exceeds the amplitude threshold;

comparing the first amplitude magnitude and the second magnitude; and determining that the first amplitude magnitude is larger than the second magnitude, wherein the first target gain is based on the first amplitude magnitude in response to determining that the first magnitude is larger than the second amplitude magnitude.

15. The method of claim 14, further comprising:

determining the first amplitude magnitude based on an absolute value of the first audio signal; and determining the second amplitude magnitude based on an absolute value of the second audio signal.

16. The method of claim 13, further comprising:

maintaining the variable gain at the first target gain for a third duration after the second time, prior to the gradual increase of the variable gain to the initial gain.

17. The method of claim 16, wherein:

the first duration is equal to the delay, which is between 0.5 ms and 2.5 ms, the second duration is between 70 ms and 300 ms, and the third duration corresponding is between 0.4 ms and 1 ms.

18. The method of claim 13, wherein the initial gain corresponds to a unity gain, such that an amplitude of the first delayed audio single is unchanged when multiplied by the unity gain.

19. The method of claim 18, wherein the first target gain, relative to the unity gain, is equal to the amplitude threshold divided by the first amplitude magnitude.

20. The method of claim 13, wherein:

the third time occurs after the first time and before an end of the second duration;

wherein the variable gain at the third time is greater than the second target gain; and the variable gain is less than or equal to the second target gain by a fourth time when the second peak is output after the delay.

* * * * *